US006767412B2

(12) United States Patent
Friedrich et al.

(10) Patent No.: US 6,767,412 B2
(45) Date of Patent: Jul. 27, 2004

(54) METHOD FOR PRODUCING NON-GRAIN-ORIENTED MAGNETIC STEEL SHEET

(75) Inventors: Karl Ernst Friedrich, Moers (DE); Brigitte Hammer, Voerde (DE); Rudolf Kawalla, Niederbobritzsch (DE); Olaf Fischer, Bochum (DE); Jürgen Schneider, Bochum (DE); Carl-Dieter Wuppermann, Krefeld (DE)

(73) Assignee: ThyssenKrupp Stahl AG, Duisburg (DE)

( * ) Notice: Subject to any disclaimer, the term of this patent is extended or adjusted under 35 U.S.C. 154(b) by 0 days.

(21) Appl. No.: 10/221,685

(22) PCT Filed: Mar. 15, 2001

(86) PCT No.: PCT/EP01/02974

§ 371 (c)(1),
(2), (4) Date: Jan. 14, 2003

(87) PCT Pub. No.: WO01/68925

PCT Pub. Date: Sep. 20, 2001

(65) Prior Publication Data

US 2003/0188805 A1 Oct. 9, 2003

(30) Foreign Application Priority Data

Mar. 16, 2000 (DE) ..... 100 12 838
Mar. 29, 2000 (DE) ..... 100 15 691

(51) Int. Cl.[7] ..... H01F 1/00

(52) U.S. Cl. ..... 148/121; 148/120; 148/111; 148/112

(58) Field of Search ..... 148/110, 111, 148/112, 120, 121

(56) References Cited

U.S. PATENT DOCUMENTS 4,177,091 A * 12/1979 Fiedler ..... 148/111
6,503,339 B1 * 1/2003 Pircher et al. ..... 148/120

FOREIGN PATENT DOCUMENTS

| | | |
|---|---|---|
| BE | 659 612 | 5/1965 |
| DE | 19807122 | 9/1999 |
| EP | 0 263 413 | 9/1987 |
| EP | 0 779 369 | 6/1997 |
| JP | 6220537 | 8/1994 |

* cited by examiner

*Primary Examiner*—John P Sheehan
(74) *Attorney, Agent, or Firm*—Proskauer Rose LLP

(57) ABSTRACT

The invention relates to a method for producing non-grain-oriented hot-rolled magnetic steel sheet in which from a raw material such as cast slabs, strip, roughed strip or thin slabs produced from a steel comprising (in weight %) C: 0.0001–0.05%; Si: ≦1.5%; Al: ≦0.5%, wherein [% Si]+2[% Al]≦1.8; Mn: 0.1–1.2%; if necessary up to a total of 1.5% of alloying additions such as P, Sn, Sb, Zr, V, Ti, N, Ni, Co, Nb and/or B, with the remainder being iron and the usual impurities, in a finishing roll line at temperatures above the $Ar_1$ temperature, a hot strip with a thickness ≦1.5 mm is rolled, wherein at least the last forming pass of hot rolling is carried out in the mixed region austenite/ferrite and wherein the total deformation $\epsilon_H$ achieved during rolling in the mixed region austenite/ferrite is <35%. With the method according to the invention, it is possible in particular to economically produce thicker magnetic steel sheet which is not grain-oriented and which has good magnetic properties.

38 Claims, 2 Drawing Sheets

Diag. 1

Diag. 2

METHOD FOR PRODUCING NON-GRAIN-ORIENTED MAGNETIC STEEL SHEET

BACKGROUND OF THE INVENTION

The invention relates to a method for producing non-grain-oriented magnetic steel sheet. In this document, "non-grain-oriented magnetic steel sheet" refers to magnetic steel sheet as defined in DIN EN 10106 ("finally-annealed magnetic steel sheet") and DIN EN 10165 ("magnetic sheet which has not been finally-annealed"). Furthermore, this also includes more strongly anisotropic types, provided they are not deemed to be grain-oriented magnetic steel sheet.

Non-grain-oriented magnetic steel sheets with a thickness ranging from 0.65 to 1 mm are for example used in the production of motors which are only switched on for a short time of operation. Typically, such motors are used in the field of domestic appliances or equipment, or as auxiliary drives in motor vehicles. Such motors are intended to produce high performance, while energy consumption only plays a subordinate role.

A first method for producing non-grain-oriented hot-rolled magnetic steel sheet is known from DE 198 07 122.A1. In the known method, a raw material comprising (in mass per cent) 0.001 to 0.1% C, 0.05 to 3.0% Si, up to 0.85% Al, wherein % Si+2Al≦3.0%, and 0.5–2.0% Mn, with the remainder being iron and the usual impurities, is hot rolled, either directly from the casting heat or after reheating, to a temperature of at least 900° C. During hot-rolling, two or more forming passes are carried out in a targeted way in the two-phase region austenite/ferrite. In this way, if necessary a cold-rolled and finally-treated magnetic steel sheet can be produced in a manner which saves time and energy, said magnetic steel sheet having improved magnetic characteristics when compared to conventional sheet of this type.

In the conventional production of non-grain-oriented magnetic steel sheet, as is for example described in EP 0 897 993 A1, usually a slab or thin slab cast from a steel of a particular composition, is rough rolled to form a roughed strip. This roughed strip is subsequently hot-rolled in several passes. If required, the hot-rolled strip is annealed and subsequently coiled. After coiling, as a rule, pickling and further annealing of the hot strip take place, said hot strip being finally cold-rolled to final thickness in one step, or in several steps with intermediate annealing. If required, supplementary skin-pass rolling is carried out. If required by the end user, the cold-rolled strip is also subjected to final annealing.

Instead of rough rolling a roughed strip from a cast slab, it is also possible to use thin slabs or to use cast roughed strip directly to produce magnetic sheets. When using cast roughed strip, there is also the option of casting extremely thin strip with dimensions which approximate the dimensions of the hot strip to be produced. Technological advantages and cost advantages can be achieved by integrating casting of such a roughed strip and hot-rolling of such a strip in a continuous process.

Each of the individual processing steps during the production has an influence on the magnetic characteristics of the end product. For this reason for example, the pass sequence and the state of the microstructure in the hot strip during each roll pass are set during hot-rolling, depending on the transformation behaviour of the steel which is governed by the composition of the steel by way of the temperature at the beginning of rolling and the cooling carried out between the individual roll passes, such that the desired magnetic characteristics of the end product are achieved. Likewise, the characteristics of the end product are determined by the annealing temperatures, the coiling temperature and the deformation during cold rolling.

Due to the large number of production steps, the production of magnetic steel sheet is technically demanding and expensive. This is a disadvantage in particular in the case of sheet of increased thickness.

SUMMARY OF THE INVENTION

It is thus the object of the invention to provide a method which makes it possible in particular to economically produce thicker magnetic steel sheet which is not grain-oriented and which has good magnetic properties.

This object is met by a method for producing non-grain-oriented hot-rolled magnetic steel sheet in which from a raw material such as cast slabs, strip, roughed strip or thin slabs, said raw material comprising a steel with (in weight per cent)

C: 0.0001–0.05%;

SI: ≦1.5%;

Al: ≦0.5%; wherein [%Si]+2[% Al]≦1.8;

Mn: 0.1–1.2%;

with the remainder being iron as well as the usual impurities; is produced; in a finishing roll line at temperatures which are above the $Ar_1$-temperature, a hot strip of a thickness ≦1.5 mm is rolled, wherein at least the last forming pass of hot rolling is carried out in the mixed region austenite/ferrite, and wherein the total deformation $\epsilon_H$ achieved during rolling in the mixed region austenite/ferrite is ≦35%. Optionally, the steel used according to the invention can comprise up to a total of 1.5% of alloying additions, such as P, Sn, Sb, Zr, V, Ti, N, Ni, Co, Nb and/or B.

DETAILED DESCRIPTION OF THE INVENTION

Figure 1:
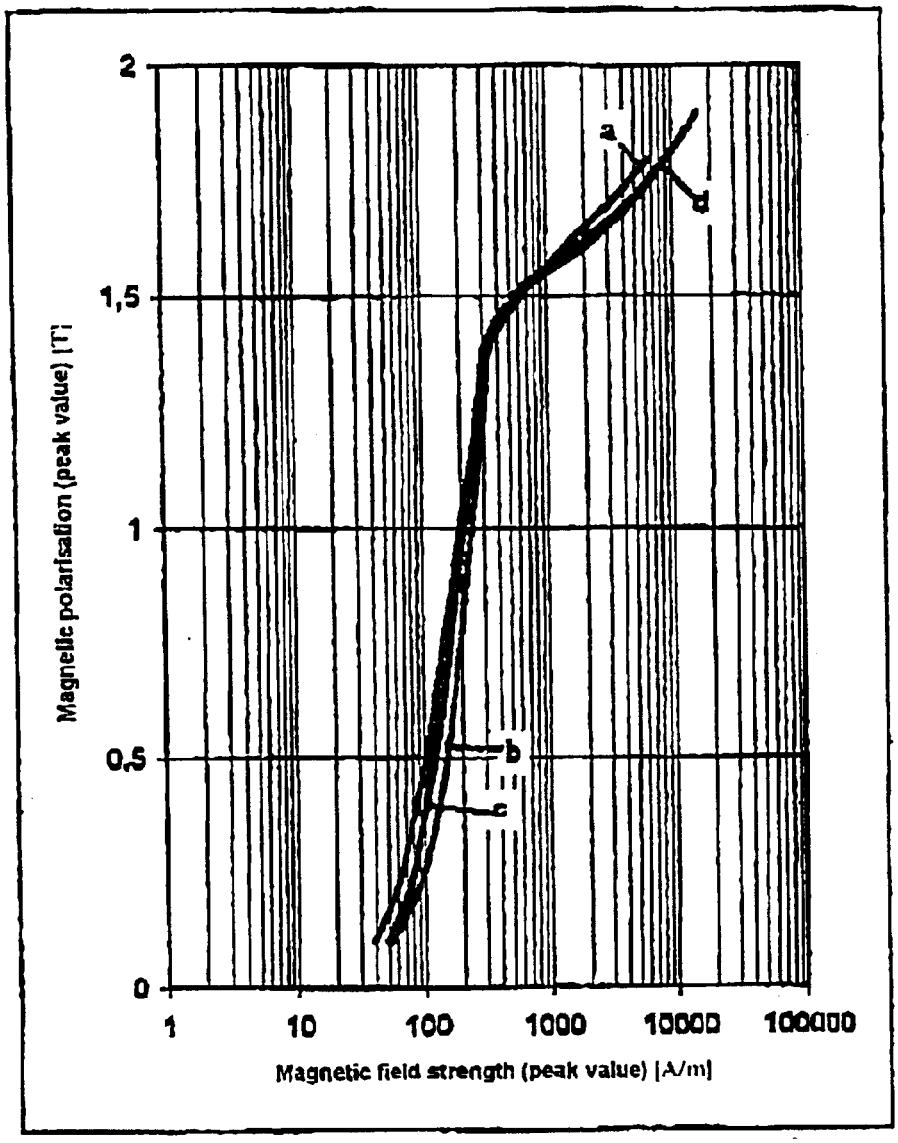
FIG. 1 is a diagram showing the logarithmic curve of the magnetic polarization of three magnetic steel sheets a, b, c, and d.
Figure 2:
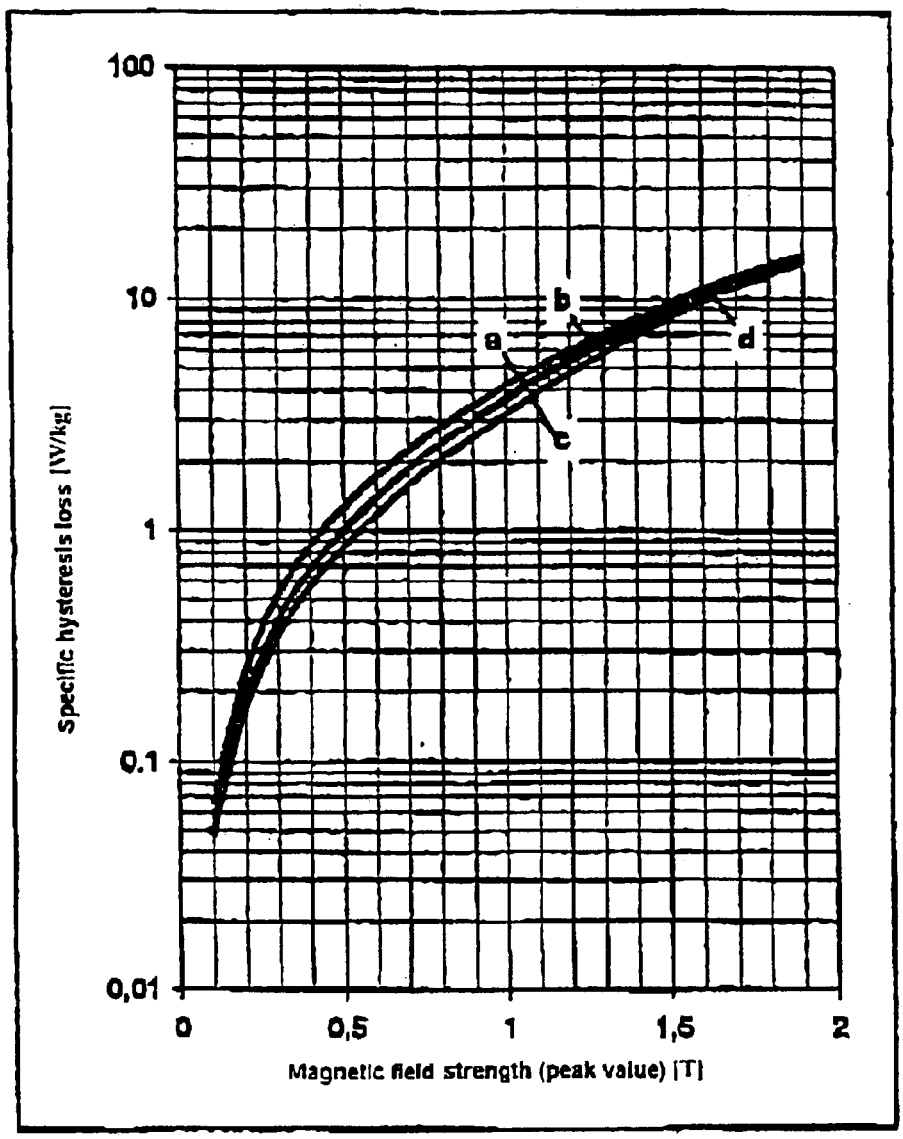
FIG. 2 is a diagram showing the logarithmic curve of the specific hysteresis of three magnetic steel sheets a, b, c, and d.

According to the invention, a strip, cast from austenite-forming steel and used directly from the casting heat, is rolled to form a hot strip. The rolling conditions during hot-rolling are such that complete ferrite transformation has not been finished at the time when rolling is complete. Instead, at least the last pass takes place in the mixed region austenite/ferrite, while all other passes are rolled in the austenite.

By carrying out production of the raw material and hot rolling of the magnetic steel sheet in a process according to the invention, non-grain-oriented magnetic steel strip can be produced which is thin enough for shipment to the end user without the need for renewed cold-rolling for thickness reduction. Particularly good results can be achieved with the method according to the invention if the raw material is produced as a cast thin slab or cast strip, and if hot rolling is carried out as a continuous process following the production of the raw material. Thus, hot strips which have been produced according to the invention from a raw material produced on a cast-rolling plant and subjected to continuous further processing, have excellent characteristics.

It has been shown that when observing the operating conditions as provided according to the invention, hot-rolled non-grain-oriented magnetic steel sheet can be produced whose characteristics are at least equivalent to magnetic steel sheet which has been cold-rolled in the conventional way, following hot-strip production. The method according to the invention further makes it possible to economically produce high-grade magnetic steel sheet with good magnetic characteristics, while saving costly and time-consuming process steps, which in the state of the art have always been assumed to be necessary.

Normally, after completion of hot-rolling, the hot strip, which has been cooled if necessary, is coiled. The coiling temperature is preferably at least 700° C. Experience has shown that if this coiling temperature is maintained, hot-strip annealing can be done without entirely or at least to a significant degree. This is because the hot strip is already being softened in the coil, wherein the parameters which determine the characteristics of said hot strip, parameters such as grain size, texture and precipitation, are positively influenced. In this context it is particularly advantageous if the strip is subjected to passive annealing, using the coil heat. Such annealing, carried out in-line from the coil heat, of the hot strip which has been coiled at high temperature and which has not undergone significant cooling in the coil, may completely replace hot-strip hood-type annealing which might otherwise have been necessary. In this way, annealed hot strip with particularly good magnetic and technological characteristics can be produced. The required effort in time and energy is considerably reduced when compared to the time and energy required during conventional hot-strip annealing which is carried out to improve the properties of magnetic steel sheet.

As an alternative or as a supplement to "passive" annealing in the coil, the strip can be subjected to annealing following coiling, provided the properties to be achieved require this. Irrespective of the form in which hot-strip annealing is carried out, it may be advantageous if annealing is carried out in the conventional way in an oxygen-reduced atmosphere.

According to another embodiment of the invention, which is particularly suitable for processing a steel with an Si content of at least 0.7% by weight, after rolling in the finishing roll line, the hot strip is coiled at a coiling temperature of less than 600° C., in particular less than 550° C. In the alloys concerned, coiling at these temperatures leads to a strengthened hot-strip state. Further improvements in the characteristics of magnetic steel sheet coiled and alloyed in this way can be achieved in that the coiled hot strip is cooled at an accelerated rate, in the coil, immediately following coiling.

Practical tests have shown that magnetic steel sheet hot strip with particularly good characteristics can be produced if most of the deformation during hot rolling clearly takes place in the austenite region. Thus, a further embodiment of the invention, which embodiment takes account of this result, is characterised in that deformation $\epsilon_H$ achieved during rolling in the mixed region austenite/ferrite, is limited to 10%–15%.

Irrespective of the degree of deformation of the hot strip in the mixed region $\gamma/\alpha$, optimal temperature management in terms of a prevention of cooling of the roll stock can be achieved by a suitable selection of the ratio of the degree of forming to the speed of forming, i.e. by using the heat produced during deformation, and thus complete transformation to ferrite can be prevented.

In this context, the term "total deformation $\epsilon_H$" refers to the ratio of the thickness reduction during rolling in the respective phase region to the thickness of the strip when it enters the respective phase region. According to this definition, the thickness of a hot strip which has been produced according to the invention, for example after rolling in the austenitic region, is $h_0$. During subsequent rolling in the two-phase mixed region, the thickness of the hot strip is reduced to $h_1$. According to the definition, during mixed rolling, this results in a total deformation $\epsilon_H$ to $(h_0-h_1)/h_0$, where $h_0$=thickness at the time of entry into the first roll stand passed in the mixed state austenite/ferrite, and $h_1$=thickness when leaving the last roll stand passed in the mixed state.

In order to improve the quality of the strip surface and further processability, it is advantageous if the hot strip is pickled after coiling.

If the end user demands a finally annealed magnetic steel sheet, it is advantageous to anneal the hot strip after pickling at an annealing temperature of at least 740° C. to obtain a finally-annealed magnetic steel strip. If by contrast, final annealing after pickling is carried out at a lower annealing temperature of at least 650° C., then a magnetic steel strip is obtained which has not been finally annealed, which if required, can be subjected to final annealing at the end-user's premises. Depending on the characteristics of the respective alloy, the desired characteristics of the magnetic steel sheet and the plant and equipment available, either of the annealing treatments can be carried out either in a hood-type furnace or in a continuous furnace.

A further improvement in the processability of the hot magnetic steel strip produced and shipped according to the invention, can be achieved in that the pickled hot strip is smooth-rolled at a degree of forming of up to 3%. During such rolling, uneven areas in the surface of the strip are smoothed out without there being any considerable effect on the microstructure generated as part of hot rolling.

As an alternative or as a supplement to a pure smoothing pass of the type mentioned above, dimensional accuracy and surface quality of the hot-rolled strip produced according to the invention can further be improved in that the pickled hot strip is skin pass rolled at a degree of forming exceeding 3% to 15%. Again, this re-rolling does not lead to any micro-structural changes which would be comparable to the changes which are usually brought about in a targeted way during cold rolling, because of the high degree of forming achieved during cold rolling.

A further advantageous embodiment of the invention is characterised in that hot rolling in the mixed region is accompanied by lubrication. Hot-rolling with lubrication results in less shearing deformation, so that the rolled strip has a more homogenous structure along its cross section. Furthermore, lubrication results in reduced rolling forces so that increased thickness reduction is possible in the respective roll pass.

Preferably, the final thickness of the hot strip is 0.65 mm to 1 mm. There is considerable demand, in the market, for economically produced and thus economically priced strip of this thickness.

The method according to the invention is particularly suitable for processing steels with an Si content of max. 1 weight %. Such steels have a pronounced austenite phase so that the transition from the austenite to the mixed phase austenite/ferrite can be controlled particularly accurately.

If the carbon content of the steel exceeds 0.005 weight %, it is advantageous if the hot strip is annealed in a decarburising medium prior to finishing and shipment.

Below, the invention is explained in more detail with reference to exemplary embodiments:

Hereinafter, "J2500", "J5000" and "J10000" respectively, designate the magnetic polarisation at magnetic field strengths of 2500 A/m, 5000 A/m and 10000 A/m respectively.

"P 1.0" and "P 1.5" refer to the hysteresis loss at a polarisation of 1.0 T and 1.5 T respectively, and a frequency of 50 Hz.

The magnetic properties stated in the following tables have been measured on individual strips along the direction of rolling.

Table 1 shows the content, in weight %, of the alloying constituents essential to the properties, of steels used for the production of magnetic steel sheet according to the invention.

TABLE 1

| Steel | C | Si | Al | Mn |
|---|---|---|---|---|
| A | 0.008 | 0.10 | 0.12 | 0.34 |
| B | 0.007 | 1.19 | 0.13 | 0.23 |

Melts formed according to the compositions shown in Table 1 were continuously cast in a cast-rolling plant to produce a roughed strip which again was continuously fed to a separate hot-roll line comprising several roll stands.

Tables 2a–2c show the magnetic properties $J_{2500}$, $J_{5000}$, $J_{10000}$, $P_{1.0}$ and $P_{1.5}$ for three magnetic steel sheets A1–A3 and B1–B3, made from the steels A and B respectively. During hot-rolling of these magnetic steel sheets A1–A3 and B1–B3, the emphasis of deformation was placed in the region in which the respective strip was in the austenitic state. By contrast, only one roll pass was carried out in the mixed region austenite/ferrite. The total deformation $\epsilon_H$ achieved during this process was less than 35%, in particular 30%.

Subsequent to rolling, the hot strip were coiled at a coiling temperature of 750° C.

TABLE 2a

| Sheet | $J_{2500}$ [T] | $J_{5000}$ [T] | $J_{10000}$ [T] | $P_{1.0}$ [W/kg] | $P_{1.5}$ [W/kg] |
|---|---|---|---|---|---|
| Al | 1.623 | 1.704 | 1.513 | 5.494 | 12.457 |
| Bl | 1.646 | 1.717 | 1.556 | 4.466 | 9.593 |

TABLE 2b

| Sheet | $J_{2500}$ [T] | $J_{5000}$ [T] | $J_{10000}$ [T] | $P_{1.0}$ [W/kg] | $P_{1.5}$ [W/kg] |
|---|---|---|---|---|---|
| A2 | 1.651 | 1.726 | 1.564 | 5.354 | 13.548 |
| B2 | 1.638 | 1.716 | 1.550 | 3.614 | 8.554 |

TABLE 2c

| Sheet | $J_{2500}$ [T] | $J_{5000}$ [T] | $J_{10000}$ [T] | $P_{1.0}$ [W/kg] | $P_{1.5}$ [W/kg] |
|---|---|---|---|---|---|
| A3 | 1.658 | 1.728 | 1.578 | 4.892 | 11.073 |
| B3 | 1.611 | 1.690 | 1.532 | 3.062 | 7.641 |

In the case of examples A1, B1 (Table 2a), after cooling, the hot strips were finished directly to form the usual commercial magnetic steel sheets and subsequently before being shipped to the end user. In the case of examples A2, B2 (Table 2b), the hot strips were pickled and additionally subjected to a smoothing pass prior to shipment to the end user. During this smoothing pass, a deformation $\epsilon_H$ of max. 3% was achieved. Prior to shipment, the strips A3, B3 (Table 2c) were pickled and then skin pass rolled.

Comparison tests carried out on magnetic steel sheet 1 mm in thickness, produced according to the method according to the invention, said sheet having been hot rolled and cold rolled in the conventional way, show that the achievable values of magnetic polarisation and the achievable values of the specific hysteresis loss of magnetic steel sheet produced according to the invention, agree within close ranges, with the values which were determined for the respective characteristics, in conventionally produced magnetic steel sheet.

Diagram 1 shows the logarithmic curve of the magnetic polarisation of three magnetic steel sheets a, b, c, produced according to the invention, and of one sheet d, produced in a conventional way, in relation to the magnetic field strength. Sheet a was used directly, sheet b was subjected to a smoothing pass, and sheet c was subjected to skin pass rolling.

Diagram 2 shows the logarithmic curve of the specific hysteresis loss of three magnetic steel sheets a, b, c, produced according to the invention, and of one sheet d, produced in a conventional way, in relation to the magnetic polarisation.

The diagrams clearly show that the characteristics of the sheets a, b, c, produced according to the invention, only slightly differ from the characteristics of conventionally produced magnetic steel sheet. This shows that with optimisation of the rolling strategy applied during hot rolling, undertaken according to the invention, and with the removal of costly cold rolling, high-quality marketable magnetic steel sheet can be produced.

What is claimed is:

1. A method for producing non-grain-oriented hot-rolled magnetic steel sheet comprising:

producing a raw material in the form of cast slabs, strip, roughed strip or thin slabs from a steel comprising in weight %:

C: 0.0001–0.05%;

Si: ≦1.5%;

Al: ≦0.5%, wherein [% Si]+2[% Al]≦1.8;

Mn: 0.1–1.2%;

balance iron and inevitable impurities;

hot rolling said raw material to a hot strip with a thickness ≦1.5 mm in a finishing roll line at temperatures above the $Ar_1$ temperature; wherein at least the last forming pass of the hot rolling step is carried out in a two phase austenite/ferrite region, and wherein a total deformation $e_H$ achieved during the hot rolling step in the two phase austenite/ferrite region is <35%.

2. The method of claim 1, wherein the steel comprises up to a total of 1.5% of alloying additions selected from the group consisting of P, Sn, Sb, Zr, V, Ti, N, Ni, Co, Nb and B.

3. The method of claim 1 wherein the raw material is produced as cast thin slab or cast strip and wherein the hot rolling step follows continuously after the raw material is produced.

4. The method of claim 1, further comprising coiling said hot strip.

5. The method of claim 4, wherein the coiling step occurs at a temperature of at least 700° C.

6. The method of claim 5, further comprising subjecting the hot strip to passive annealing using the coil heat.

7. The method of claim 5, further comprising annealing the hot strip after the coiling step.

8. The method of claim 4, further comprising annealing the hot strip in an oxygen-reduced atmosphere.

9. The method of claim 4, wherein the coiling step occurs at a temperature ≦600° C.

10. The method of claim 9, further comprising cooling the coiled hot strip in the coil at an accelerated rate immediately following coiling.

11. The method of claim 1, wherein the total deformation $e_H$ achieved during the hot rolling step in the two phase austenite/ferrite region is 10%–15%.

12. The method of claim 4 further comprising pickling the hot strip following coiling.

13. The method of claim 12 further comprising annealing the hot strip at an annealing temperature of at least 740° C. to obtain a finally annealed magnetic steel strip.

14. The method of claim 12 further comprising annealing the hot strip at an annealing temperature of at least 650° C. to obtain a magnetic steel strip, wherein said magnetic steel strip is not final annealed.

15. The method of claim 13, wherein said annealing step takes place in a hood-type furnace.

16. The method of claim 13, wherein said annealing step takes place in a continuous furnace.

17. The method of claim 13 further comprising:

finishing the hot strip; and shipping the hot strip, wherein said hot strip has not been cold-rolled.

18. The method of claim 12 further comprising burnishing the hot strip at a degree of forming of ≦3%.

19. The method of claim 18, further comprising:

finishing the burnished strip; and shipping the burnished strip.

20. The method of claim 12 further comprising skin pass rolling the hot strip at a degree of forming of >3%–15%.

21. The method of claim 20, further comprising:

finishing the skin pass rolled strip; and shipping the skin pass rolled strip.

22. The method of claim 1, wherein the hot strip comprises a final thickness of 0.65 to 1 mm.

23. The method of claim 1, wherein the hot rolling step in the two phase austenite/ferrite region is accompanied by lubrication.

24. The method of claim 1, wherein the Si content of the steel is max 1% by weight.

25. The method of claim 13, wherein the C content of the steel exceeds 0.005 weight % and wherein the hot strip is annealed in a decarburating medium prior to finishing and shipment.

26. The method according to claim 1, wherein the steel comprises up to a total of 1.5% of alloying additions selected from the group consisting of P, Sn, Sb, Zr, V, Ti, N, Ni, Co, Nb or B.

27. The method of claim 14, wherein said annealing step takes place in a hood-type furnace.

28. The method of claim 14, wherein said annealing step takes place in a continuous furnace.

29. The method of claim 14 further comprising:

finishing the hot strip; and shipping the hot strip, wherein said hot strip has not-been cold-rolled.

30. The method of claim 13 further comprising burnishing the hot strip at a degree of forming of ≦3%.

31. The method of claim 30, further comprising:

finishing the burnished strip; and shipping the burnished strip.

32. The method of claim 14 further comprising burnishing the hot strip at a degree of forming of ≦3%.

33. The method of claim 32, further comprising:

finishing the burnished strip; and shipping the burnished strip.

34. The method of claim 13 further comprising skin pass rolling the hot strip at a degree of forming of >3%–15%.

35. The method of claim 34, further comprising:

finishing the skin pass rolled strip; and shipping the skin pass rolled strip.

36. The method of claim 14 further comprising skin pass rolling the hot strip at a degree of forming of >3%–15%.

37. The method of claim 36, further comprising:

finishing the skin pass rolled strip; and shipping the skin pass rolled strip.

38. The method of claim 14, wherein the C content of the steel exceeds 0.005 weight % and wherein the hot strip is annealed in a decarburating medium prior to finishing and shipment.

* * * * *